US006568020B1

(12) United States Patent
Hosokawa

(10) Patent No.: US 6,568,020 B1
(45) Date of Patent: May 27, 2003

(54) TOOTHBRUSHES HAVING BRUSH BRISTLES CAPABLE OF OSCILLATING PERPENDICULARLY WITH RESPECT TO A TOOTH SURFACE

(76) Inventor: Yukiji Hosokawa, 60-1, Tokuhara, Ishii-cho, Anjo-shi, Aichi-ken (JP)

( * ) Notice: Subject to any disclaimer, the term of this patent is extended or adjusted under 35 U.S.C. 154(b) by 331 days.

(21) Appl. No.: 09/654,749

(22) Filed: Sep. 5, 2000

(30) Foreign Application Priority Data

Sep. 2, 1999 (JP) ..... 11-249263

(51) Int. Cl.[7] ..... A46B 9/04; A46B 13/02

(52) U.S. Cl. ..... 15/22.1; 15/167.1; 15/22.2; 433/216

(58) Field of Search ..... 15/22.1, 22.2, 15/167.1; 433/216

(56) References Cited

U.S. PATENT DOCUMENTS

| | | | |
|---|---|---|---|
| 4,864,676 A | | 9/1989 | Schaiper |
| 4,979,256 A | | 12/1990 | Branford |
| 5,406,664 A | * | 4/1995 | Hukuba |

FOREIGN PATENT DOCUMENTS

| | | |
|---|---|---|
| JP | 3-128003 | 5/1991 |
| JP | 4-227209 | 8/1992 |
| JP | 5-076416 | 3/1993 |
| JP | 5-154014 | 6/1993 |
| JP | 6-327517 | 11/1994 |
| JP | 8-117029 | 5/1996 |
| JP | 8-224126 | 9/1996 |
| WO | WO 92/17092 | 10/1992 |
| WO | WO 92/19177 | 11/1992 |

* cited by examiner

*Primary Examiner*—Randall E. Chin
(74) *Attorney, Agent, or Firm*—Dennison, Schultz & Dougherty

(57) ABSTRACT

Toothbrushes are taught that may included a main body having a brush portion provided with brush bristles and protrusions for oscillating the brush bristles in a direction perpendicular to a longitudinal axis of the main body. For example, the protrusions may be provided on the main body and on a sliding member so as to generate oscillations when the protrusions slide relative to each other. In addition or in the alternative, an electric motor may be coupled to the sliding member to reciprocally move the sliding member along the longitudinal axis of the main body. Teeth may be brushed by holding the main body in a substantial fixed position with respect to the teeth and simultaneously sliding the sliding member along the shaft of the main body in order to cause the brush portion to oscillate in the direction perpendicular to the teeth.

28 Claims, 13 Drawing Sheets

TOOTHBRUSHES HAVING BRUSH BRISTLES CAPABLE OF OSCILLATING PERPENDICULARLY WITH RESPECT TO A TOOTH SURFACE

BACKGROUND OF THE INVENTION

1. Field of the Invention

The present invention relates to toothbrushes, in particular, to toothbrushes having means for oscillating the bristles in a direction perpendicular to the teeth while holding the toothbrush in a substantially fixed position with respect to the teeth.

2. Description of the Related Art

In recent years, a "Bass" method and a "scrubbing" method have been recommended for cleaning interproximal areas and periodontal pockets of teeth. If these brushing methods are utilized, the toothbrush bristles are placed in the interproximal areas or periodontal pockets at an angle of about 45° or 90° with respect to the surface of the teeth. The bristles are then reciprocally horizontally moved in short lateral strokes with respect to the teeth about 10 to 30 times in order to brush and clean the teeth. Such methods can effectively remove tartar. However, there is a danger that excess toothbrush movement will cause the dentine to wear. On the other hand, brushing using short, gentle strokes requires practice and patience. Moreover, in order to properly brush using these methods, at least 10 minutes of brushing is required.

SUMMARY OF THE INVENTION

It is, therefore, one object of the present teachings to provide improved toothbrushes that can more effectively and efficiently clean teeth.

In one aspect of the present teachings, toothbrushes are taught that have a means for oscillating the bristles in a direction that is perpendicular to the surface of the teeth. This movement permits the bristles to effectively clean interproximal areas and periodontal pockets, because the bristles are pushed inwards towards the teeth. However, preferably the brush portion is held in a substantially fixed position with respect to the teeth and the brush portion oscillates in a direction that is perpendicular to the teeth. In addition, the teeth also may be brushed horizontally using known methods. In that case, the bristles will move in and out with respect to the teeth while the toothbrush is moved in parallel to the surface of the teeth. Various means can be utilized to oscillate the bristles in a direction that is normal to the surface of the teeth, including manually operated means and electrical means.

In another aspect of the present teachings, toothbrushes may include a main body having a brush portion provided with brush bristles. First protruding portions may be formed on one or both sides of the main body. A sliding member may be disposed on or around the main body and preferably has second protruding portions that oppose the first protruding portions. Preferably, the second protruding portions may be adapted to permit the second protruding portions to slide over the first protruding portions. The main body may be held with one hand while the sliding member is held with the other hand. In that state, the sliding member is reciprocally moved relative to the main body (and a direction that is horizontal to the teeth) and the rubbing of the first and second protrusions will cause the brush portion and brush bristles to oscillate in a direction perpendicular to the teeth.

More specifically, when the second protruding portions of the sliding member slide over the first protruding portions of the main body, a slight movement is generated in a direction that is perpendicular to the sliding direction of the main body. As a result, this oscillating motion is transmitted to the brush portion of the main body. Therefore, by moving the sliding member relative to the main body and in parallel to the surface of the teeth, it is possible to cause the brush bristles to oscillate in a direction perpendicular (normal) to the surface of the teeth. Consequently, such a toothbrush can improve tooth-cleaning efficiency and reduce the amount of time that is necessary to properly clean teeth.

In another aspect of the present teachings, electrical means are coupled to the sliding member and cause the sliding member to reciprocally move with respect to the main body. This reciprocal movement will cause the first and second protruding portions to slide with respect to each other and cause the brush portion to oscillate in a direction perpendicular to the surface of the teeth. Preferably, a motor may be coupled to the sliding member in order to reciprocally move the sliding member with respect to the main body. A battery may be provided to supply power to the electrical means or an electric cord may be provided to connect the toothbrush to an electrical outlet. Various motors or other electrical devices may be utilized to reciprocally move the sliding member with respect to the main body.

Additional objects, features and advantages of the present teachings will be readily understood after reading the following detailed description together with the accompanying drawings and the claims.

DETAILED DESCRIPTION OF THE INVENTION

Figure 1:
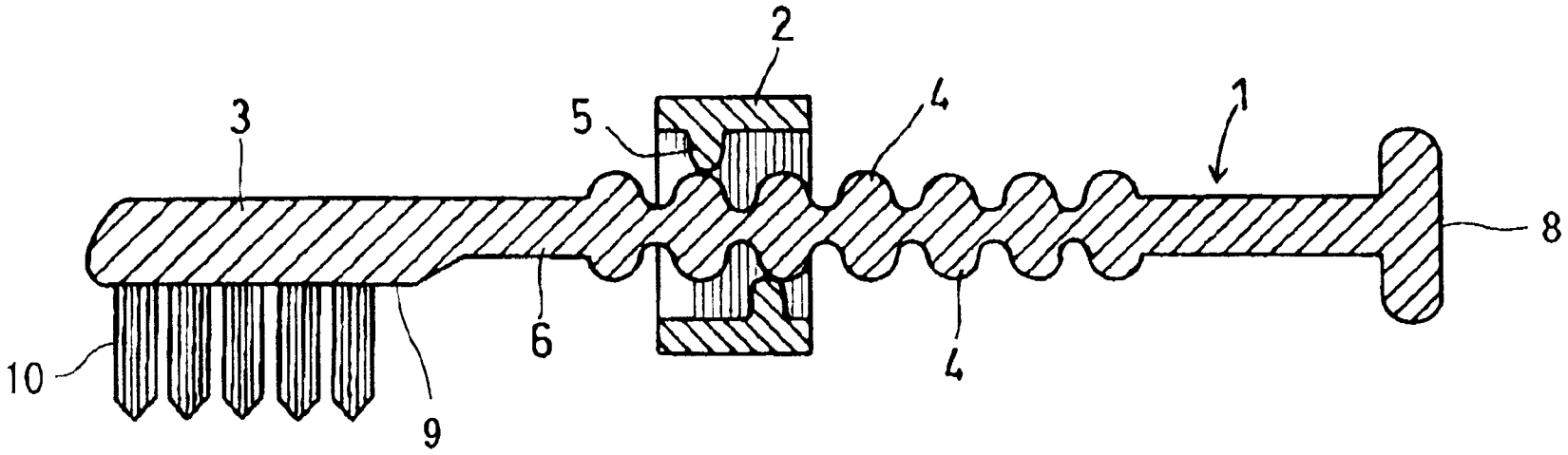
FIG. 1 is a side sectional view of a first representative toothbrush.

Preferably, a toothbrush may include a manually driven oscillating means, as shown in FIG. 1, in which a main body 1 has a brush portion 3 and a sliding member 2 installed so that it can slide with respect to main body 1. Main body 1 is provided with first protruding portions 4, and sliding member 2 is provided with second protruding portions 5. When sliding member 2 moves relative to main body 1, protruding portions 4, 5 slide against each other and cause brush portion 3 to oscillate in a direction perpendicular to the moving direction of sliding member 2 and/or main body 1. While protruding portions 4, have approximately the same shape in FIG. 1, the shape of protruding portions 4, 5 may be different. Naturally, if the shapes are different, first protruding portions 4 may be instead provided on the sliding member 2 and second protruding portions 5 may be provided on main body 1. In this embodiment, it is only important that opposing protruding portions are provided on sliding member 2 and main body 1.

First protruding portions 4 and second protruding portions may preferably include peaks and valleys that have a height difference. As noted above, first protruding portions 4 and second protruding portions 5 can have various shapes. For example protruding portions 4, 5 can be formed as a wavy surface, or at least one concave or convex spherical portion, rod-like portion, or plate-like portion can be provided, or a member capable of rotating in a gear-like fashion can be provided as a projection. When protruding portion 4, 5 are gently sloping peaks and valleys, the load caused by vibrations is decreased, which is a useful effect.

If the contact surface area of first protruding portions and second protruding portions 5 is large, a more stable oscillating motion can be obtained. On the other hand, by making either first protruding portions 4 or second protruding portions 5 short and the other portions long, it is possible to increase the range in which sliding member 2 can move with respect to main body 1. In this case, an increased number of oscillations can be obtained in each reciprocal movement of the sliding member 2 with respect to main body 1. Further, making the protruding portions 4, 5 short results in a reduced number of protrusions.

Preferably, the toothbrush is used by placing brush bristles 10 at an angle of about 45° or about 90° with respect to the surface of the teeth. The main body 1 may be held in a substantially fixed position with respect to the teeth. Sliding member 2 is preferably manually and reciprocally moved with respect to main body 1. As a result, first protruding portions 4 will slide against second protruding portions 5, thereby causing brush bristles 10 to oscillate in a direction perpendicular to the surface of the teeth. Thus, because brush bristles 10 oscillate in a direction perpendicular to the surface of the teeth, the interproximal areas and periodontal pockets within the teeth can be effectively brushed. After brushing a particular area, the position of the main body 1 can be moved to another fixed position with respect to the teeth in order to brush another area. Thus, the above-described method can be repeated for some or all portions of the mouth until the teeth have been completely brushed.

In addition, the present toothbrushes can be utilized together with the Bass method and/or the scrubbing method. Thus, instead of holding the main body 1 in a substantially fixed position while reciprocally moving sliding member 2, the main body 1 can be reciprocally moved in short strokes parallel to the teeth while reciprocally moving sliding member 2. In addition, the main body 1 can simply be held in a loose manner to allow the brush portion 3 to move laterally while reciprocally moving the sliding member 2 with respect to the main body 1. Thus, brushing efficacy can be improved by using the present toothbrushes with the Bass and or scrubbing methods.

Naturally, a variety of techniques may be utilized to impart an oscillating motion to brush bristles 10. Such techniques include various ways of providing protruding portions on the main body 1 and sliding member 2 and/or providing electrically driven oscillating means. Thus, further representative examples of the present teachings will new be described in further detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of feature and aspects disclosed in the following detail description may not be necessary to practice the invention in the broadest sense, and are instead taught merely to particularly describe some representative examples of the invention. Moreover, various features of the representative examples may be combined in ways that are not specifically enumerated in order to provide additional useful embodiments of the present teachings.

First Representative Embodiment

A first representative embodiment is shown in FIGS. 1 to 5, which shows a toothbrush having main body 1 and sliding member 2. Sliding member 2 is preferably integrally installed so that it can slide with respect to main body 1. Main body 1 preferably may include elongated base 6, which base has an almost square cross section in this first representative embodiment.

A brush portion 3 is provided on one end of base 6. Brush portion 3 may include a plate-like bristle base 9 formed continuously with base 6 and a tuft of brush bristles 10 on one surface of the bristle base 9. The tuft of brush bristles 10 can be formed in a variety of known shapes, because the design of the brush bristles 10 is not particularly limited in the present teachings. In the embodiment shown in FIG. 1, brush bristles 10 of different lengths have been attached to the bristle base 9, thereby forming a plurality of sharpened protruding portions that can facilitate penetration into the interproximal areas.

A terminal end 8 having a cross section greater than base 6 may be provided on the opposite end of main body 1. Terminal end 8 may serve as a structure for holding the toothbrush while brushing the teeth. In addition, if the cross section of terminal end 8 is greater than the cross section of sliding member 2, it may also serve as a stopper to prevent sliding member 2 from being removed from main body 1.

In this embodiment, first protruding portions 4 may be provided on both sides of main body 1. As noted above, first protruding portions 4 may be dispose in a variety of patterns and may have a variety of shapes. In this first representative embodiment, a plurality of protrusions 4 are arranged in a row with respect to base 6, whereby the protrusions 4 form gently sloping peaks and valleys along the length of main body l. Although the peaks of the first protruding portions 4 are aligned on the two sides of main body 1 in the first representative embodiment, such alignment is not required.

Figure 2:
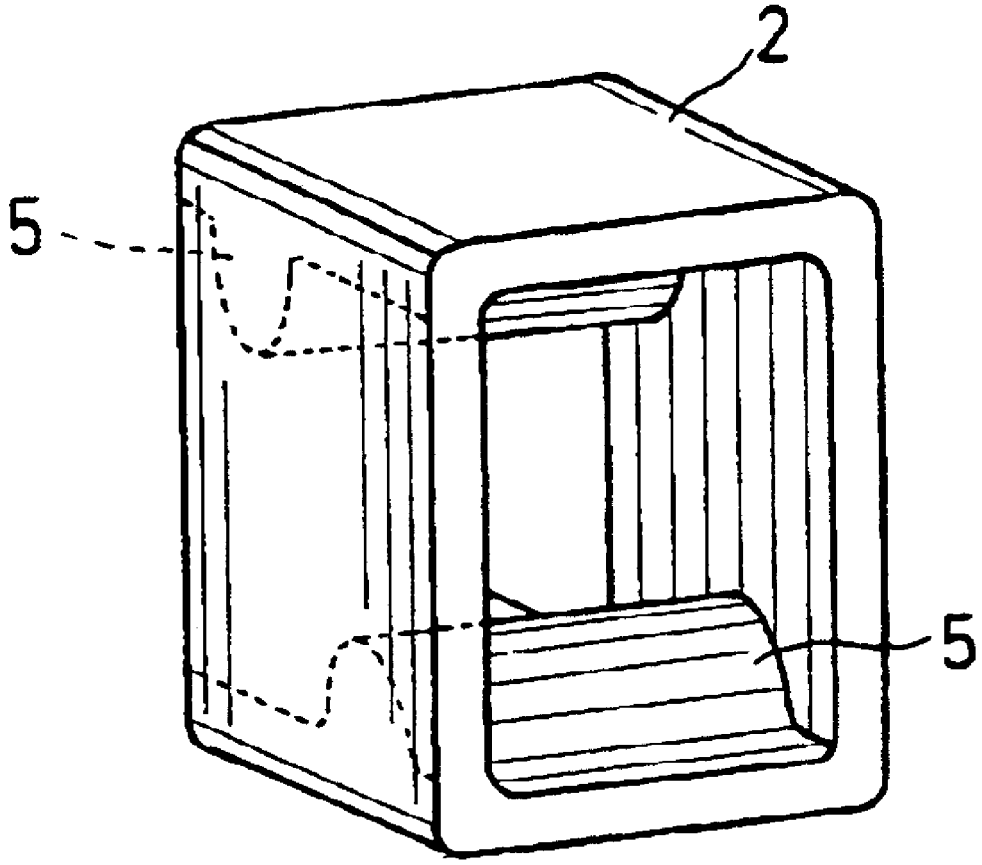
FIG. 2 is a perspective view of the sliding body shown in FIG. 1.
Figure 3A:
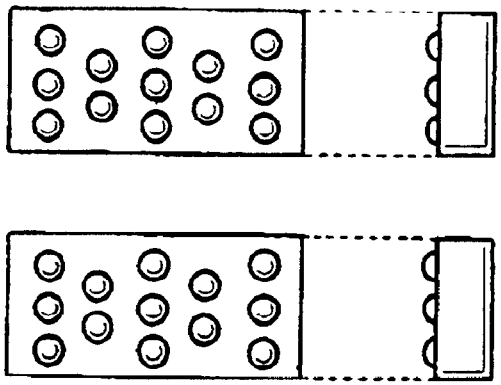
FIGS. 3(*a*), (*b*) are model drawings illustrating an example in which the first protruding portions and second protruding portions have the same shape.
Figure 3B:
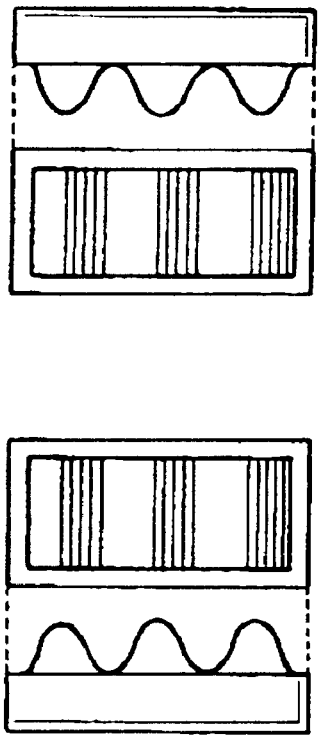
Figure 4A:
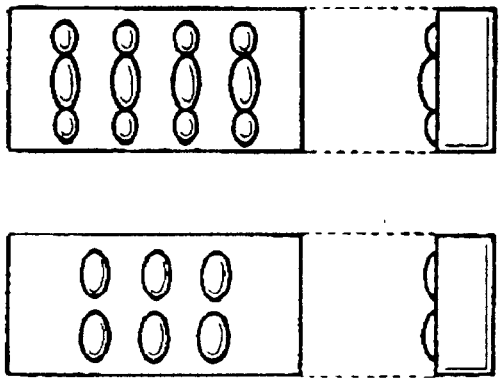
FIGS. 4(*a*), (*b*) are model drawings illustrating an example in which the first protruding portions and second protruding portions have different shapes.
Figure 4B:
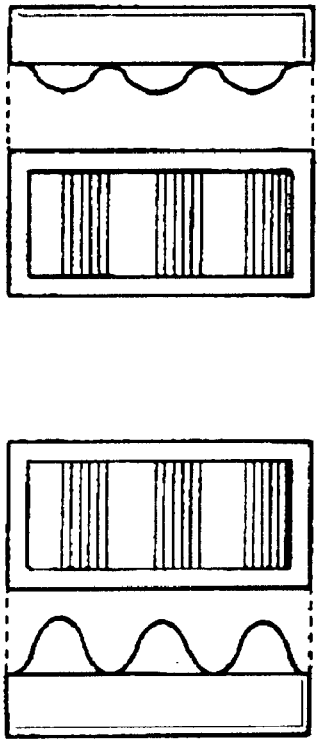

Sliding member 2 is adapted to slide with respect to main body 1. As shown in FIG. 2, sliding member 2 is substantially cylindrical in the first representative embodiment. In order to install sliding member 2, base 6 may be inserted through the cavity of sliding member 2 and slid into position. The shape of sliding member 2 also is not particularly limited, as long as sliding member 2 can slide with respect to first protruding portions. Thus, slide member 2 may also be, for example, a frame having a U-like cross section.

Second protruding portions 5 are also provided on each inner surface of sliding member 2 and face first protruding portions 4 of main body 1, although first protruding portions 4 and second protruding portions 5 may be provided only on a single side of main body 1 and sliding member 2, respectively. Second protruding portions 5 also are formed as peaks and valleys in the direction perpendicular to the direction of sliding over the main body 1. In this first representative embodiment, second protruding portions 5 are each a single wave-like peak disposed on each side of sliding member 2. Preferably, the peaks and valleys of second protruding portions 5 may have a height difference that is greater than the height difference of first protruding portions 4. Furthermore, the peak formed on one inner surface and the peak formed on the other inner surface preferably are not aligned in the sliding direction.

First protruding portions 4 can be also formed by providing a plurality of through holes or depressions in base 6 in parallel with bristles 10. In such an embodiment, the thickness of base 6 in the bristle direction determines the size of the peaks relative to the holes. In this case, the thickness of base 6 in the bristle direction is decreased and main body 1 is made compact, which is a useful effect. Furthermore, in order to decrease the thickness of base 6, the positions of peaks provided on one surface of base 6 may be shifted with respect to the positions of peaks provided on the other surface. For example, the entire base 6 may have a pleat-like shape by forming the axial line of the elongated portion along a curve (e.g., a wavy line). Wave-like peaks and valleys may be also formed on both surfaces of the base 6. Protruding portions of such shape and arrangement can be also appropriately provided in the embodiments that will be described below.

A representative method for brushing teeth, and in particular brushing interproximal areas or periodontal pockets, by using the toothbrush of the present embodiment will be described now. First, terminal end 8 and main body 1 are held with one hand and the toothbrush is placed so that brush bristles 10 form an angle of about 45° to 90° with respect to the surface of the teeth. Then, sliding member 2 is held with the other hand and sliding member 2 is moved with respect to main body 1 and in parallel to the surface of the teeth. Therefore, second protruding portions 5 of sliding member 2 slide over first protruding portions 4 of main body 1. As a result, an oscillating motion is generated in a direction that is perpendicular to the surface of the teeth and this oscillating motion is transmitted to brush portion 3. Therefore, this perpendicular oscillating motion makes it possible to effectively brush the interproximal areas or periodontal pockets.

In this embodiment, because first protruding portions X are long and second protruding portions 5 are short, a large number of oscillations are generated by a single sliding movement of main body 1 with respect to sliding member 2. Therefore, about 10–30 oscillations can be obtained in a single reciprocal motion and the time required for brushing can be shortened significantly.

Furthermore, various shapes and sizes can be utilized for the first protruding portions and second protruding portions. For example, the first protruding portions and second protruding portions can be formed to have the same shape, as shown for example in FIGS. 3(*a*), (*b*). In the alternative, the first protruding portions and second protruding portions can be formed to have different shapes, as shown for example in FIGS. 4(*a*), (*b*)

Figure 5A:
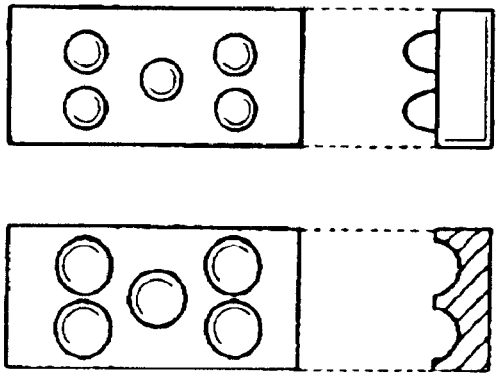
FIGS. 5(*a*), (*b*) are model drawings illustrating an example in which the first protruding portions are formed as peaks on the surface and second protruding portions are formed as valleys in the surface.
Figure 5B:
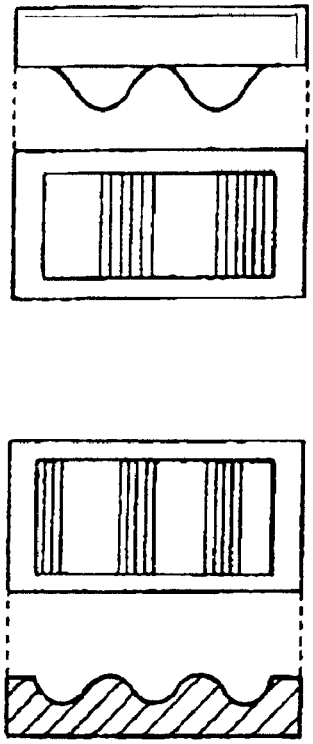

Moreover, as shown in FIGS. 5 (*a*), (*b*), one of the protrusions an be formed as a peak-like shape and the other can be formed as a valley-like shape. With such shapes, the thickness of the section provided with the two protruding portions is decreased, thereby making it possible to decrease the size of the toothbrush, which is a useful effect.

Furthermore, when protruding portions of at least one type are formed as peaks and valleys with a top-bottom height difference of no less than about 2 mm and no more than about 4 mm, it becomes easier to slide the first protruding potions along the second protruding portions. Moreover, the same effect can be produced even when the peaks and valleys are formed so that the tilt angle between the peaks and valleys is about 20° to 45°. For example, the protruding portion can be formed as a single valley or peak. Furthermore, in any of these modifications, if the number of peaks and valleys is maximized by decreasing their size, a large number of oscillations can be generated by a single sliding motion of the first protruding portions with respect to the second protruding portions, which is a useful effect. These various modifications can be appropriately used in all the toothbrushes taught herein.

Second Representative Embodiment

A second representative toothbrush is shown in FIGS. 6 to 9, which toothbrush may include main body 11, box-like container 17 and sliding member 12. A portion of main body 11 may be enclosed within container 17. Furthermore, sliding member 12 may have a cylindrical shape and may be installed so that it can slide along the outer surface of container 17 and over main body 11.

Main body 11 may include elongated base 16 and brush portion 13. Brush portion 13 is provided at the end of base 16, which is similar to the structure of the first representative embodiment.

In this embodiment, brush portion 13 is divided into sections with an appropriate spacing in the axial direction with respect to base 16 in order to facilitate the penetration of brush bristles into the interproximal area. Brush portion 13 may include a brush shaft 20, a fixed brush 21, and a plurality of movable brushes 22. Fixed brush 21 is secured to brush shaft 20 and movable brushes 22 can be move in the axial direction along brush shaft 20. Further description of movable brushes 22 will be provided below.

Figure 6:
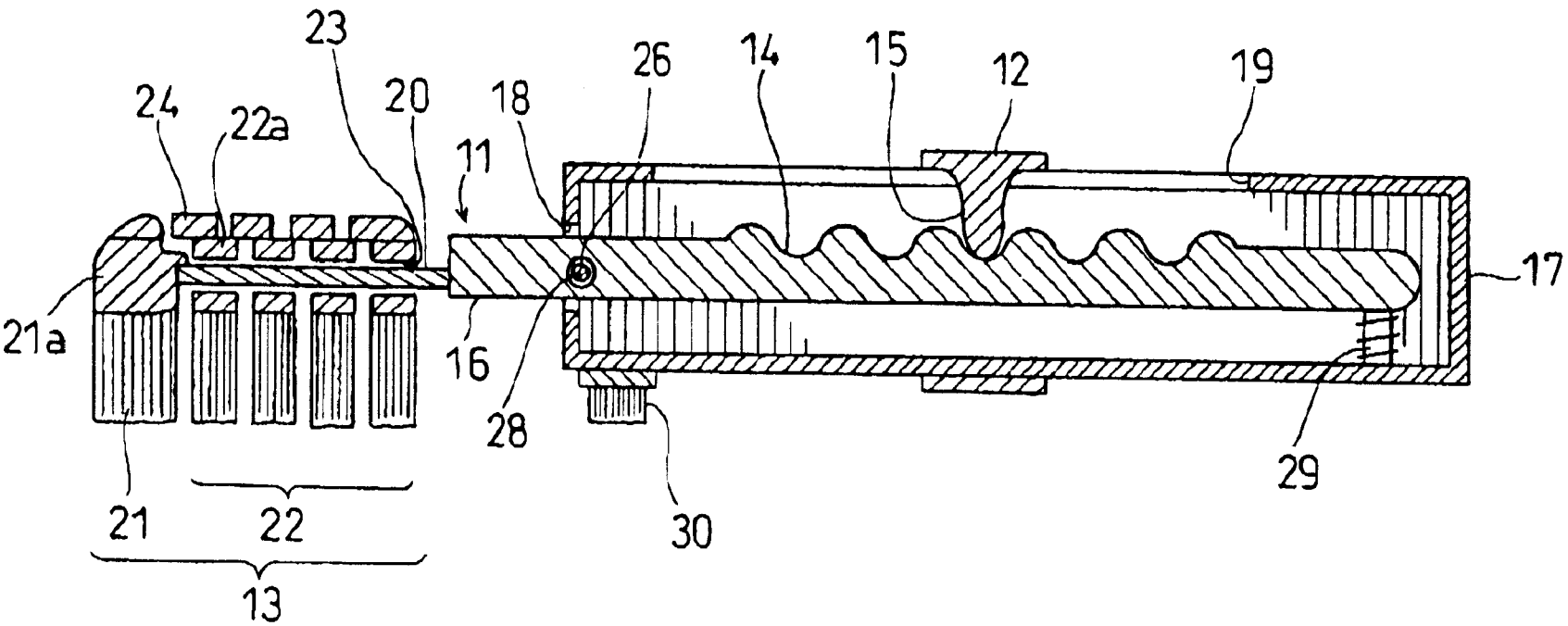
FIG. 6 is a side sectional view of a second representative toothbrush.
Figure 7:
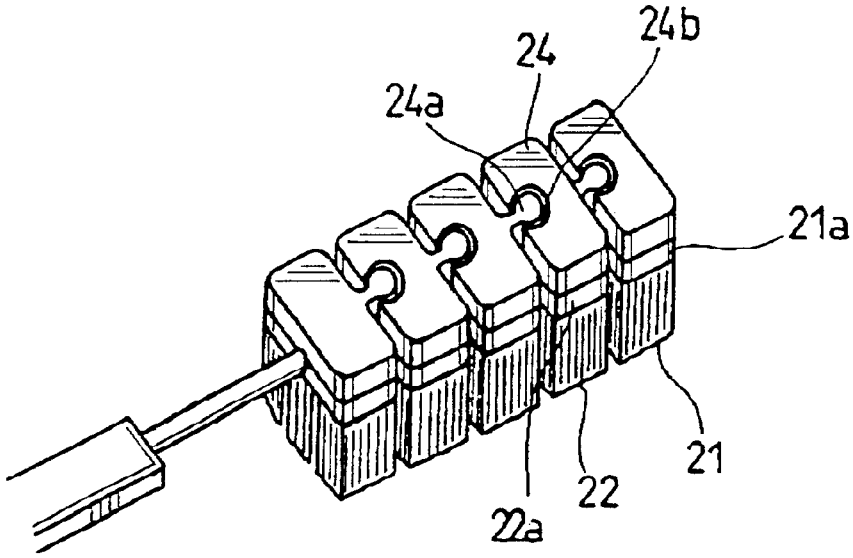
FIG. 7 is a perspective view of the brush portion shown in FIG. 6.

Brush shaft 20 is attached to one end of base 16. As shown in FIGS. 6 and 7, because brush shaft 20 has a cross sectional area that is smaller than base 16, the range of movement of movable brushes 22 can be restricted to between the fixed brush 2 and the base 16. Brush shaft 20 preferably has a length greater than the combined length of fixed brush 21 and a plurality of movable brushes 22. By increasing the length of brush shaft 20, it is possible to place movable brushes 22 between a plurality of adjacent teeth. If brush shaft 20 is installed so as to have a length of about 2–4 mm longer than the combined length of the movable brushes 22, each movable brush 22 can move only over an appropriate distance, which is a useful effect.

Fixed brush 21 and movable brushes 22 are attached to one surface of flat bristle bases 21*a*, 22*a*. As shown in FIG. 6, fixed brush 21 is fixedly mounted on the end of brush shaft 20. Mounting fixed brush 21 at the front end of brush portion 13 facilitates brushing of molars. However, fixed brush 21 can be also mounted adjacent to base 16 or in an intermediate position of brush portion 13 between two movable brushes 22.

Holes 23 are formed in the bristle base 22*a* of each movable brush 22 in order to receive the brush shaft 20. Movable brushes 22 are installed so that they can move along the brush shaft 20. Brush shaft 20 and holes 23 may have a variety of cross-sectional shapes including, for example, a flattened, rectangular or elliptical cross sectional shape. By utilizing a cross-section that does not permit the movable brushes to rotate around brush shaft 20, lateral shaking can be reduced.

Movable brushes 22 can have the same or different shape and size. Furthermore, if the maximum number of movable brushes 22 is installed within a length in which tooth brushing is easy, brush bristles can be placed in a plurality of mutually adjacent interproximal areas or periodontal pockets. Therefore, tooth brushing can be efficiently performed. For this purpose, preferably one to four movable brushes 22 are installed and more preferably, three or four movable brushes 22 are installed.

If the fixed brush 21 is bigger than movable brushes 22, main body 11 can be reliably stabilized during tooth brushing, thereby providing another useful effect.

Preferably, the spacing between the fixed brush 21 and movable brushes 22 can be changed during brushing and an appropriate device or structure may be utilized to change the distance between neighboring movable brushes 22 during brushing. Preferably, such a means for changing the distance between movable brushes 22 during brushing controls the range of separation distances so as to facilitate the penetration of each movable brush 22 between adjacent teeth. Therefore, it is preferred that this range should be changed according to the intended user, for example, for children, adults or people that have peridontitis.

Figure 8:
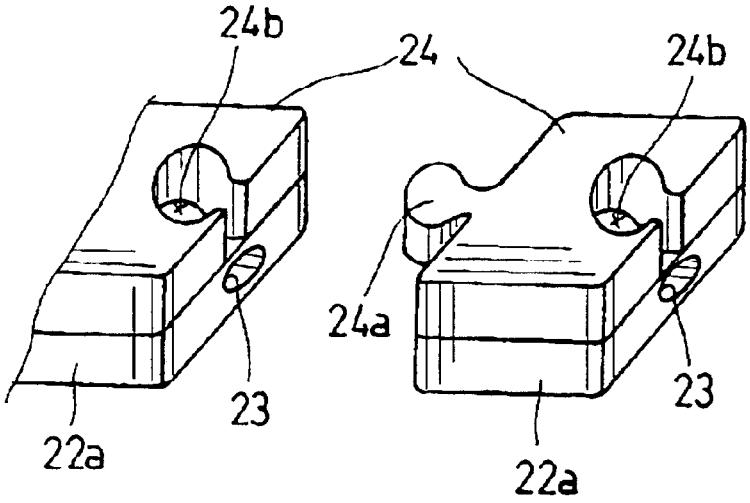
FIG. 8 is a perspective view showing the enlarged portions of the latch and bristle base shown in FIG. 6.

As shown in FIGS. 7 and 8, a preferred means for changing the distance between movable brushes 22 is latch 24 disposed on the surfaces of bristle bases 21*a*, 22*a*, which latch 24 is provide on the surface of bristle bases 21*a*, 22*a* that is opposite of the surface having the brush bristles. Preferably, latch 24 has approximately the same depth as bristle bases 21*a*, 22*a* and includes protrusion 24*a* and recess 24*b*. Preferably, protrusion 24*a* and recess 24*b* are formed such that latch 24 permits two bristle bases 21*a*, 22*b* to laterally move with respect to each. More preferably, the protrusions 24*a* protrude from bristle bases 22*a* towards the front end of brush portion 13. In addition, recesses 24*b* have a concave shape formed on the side that is closest to base 16. Recesses 24*b* may be formed to be larger than the protrusions 24*a*. Therefore, the range of separation distances between adjacent movable brushes 22 is set within the range in which protrusions 24*a* can move within recesses 24*b*.

The means for changing the distance between movable brushes 22 during brushing is not particularly limited and a variety of other structures may be utilized to provide this function. For example, a magnet may be enclosed within the bristle bases 21*a*, 22*a* of the fixed brush and each movable brush. Alternatively, a coil spring may be installed on the base 16 side of the brush shaft 20. In such an embodiment, a protective means is preferably provided to protect the tongue and lips from being caught in the spring.

Base 16 has first protruding portions 14 on at least one surface perpendicular to the bristle direction in brush portion 13. Similar to the first representative embodiment, first protruding portions 14 are preferably formed as a plurality of peaks and valleys. In this embodiment, first protruding portions 14 are in the form of a plurality of gently sloping peaks and valleys provided on the rear surface (top side in FIG. 6) of base 16 with respect to the bristle surface of brush portion 13.

Container 17 retains main body 11, but permits main body 11 to oscillate in a direction perpendicular to the longitudinal axis of container 17. Container 17 is held with a hand when the toothbrush of this embodiment is used. Container 17 can have a variety of shapes, as long as container 17 does not unnecessarily or significantly impede the transmission of oscillating motion to brush portion 13, which oscillations are generated by first protruding portions 14 sliding with respect to second protruding portions 15. For example, container 17 can be a linear body or a frame-like body surrounding the side surfaces of the portion of base 16 where first protruding portions 14 are provided. Furthermore, it can be also a plate-like body extending to the side of base 16 which is opposite of the surface where first protruding portions 14 are provided.

Figure 9:
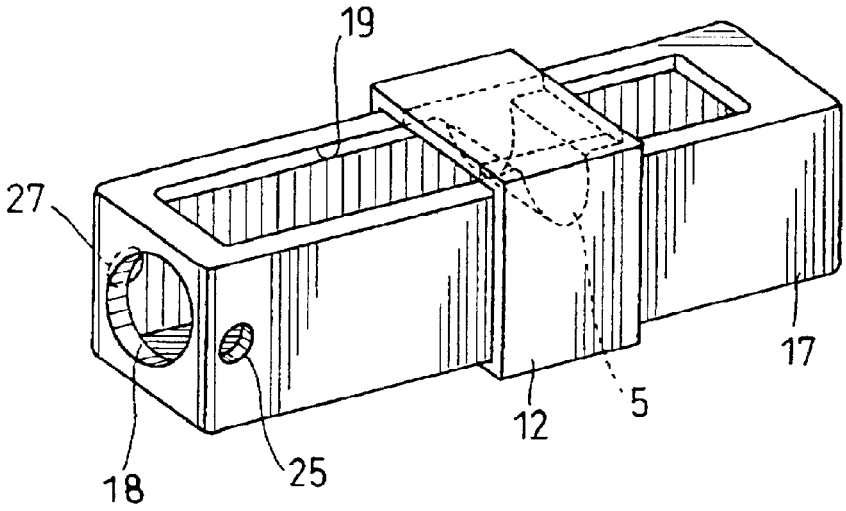
FIG. 9 is a perspective view showing how the sliding member is installed in the container shown in FIG. 6.

In this embodiment, as shown in FIGS. 6 and 9, container 17 has a box-like shape that is long enough to substantially enclose base 16 from its distal end and all first protruding portions 14. As shown in FIG. 9, the portion of container 17 that aces the first protruding portions 14 may have opening 19. Hole 18 is provided in container 17 on the side closest to brush portion 13, so that base 16 can protrude from container 17. The vertical cross section of hole 18 is preferably larger in the vertical cross section of base 16 so as not to impede the oscillating motion of main body 11.

Container 17 is connected to main body 11 to permit sliding member 12 and first protrusions 14 to act as a lever and oscillate brush portion 13. In this embodiment, as shown in FIGS. 6, 9, through opening 26 is formed in base 16. Shaft 28 is inserted in through opening 26 and is supported within orifices 25, 27 provided in the side surfaces of container 17. As a result, main body 11 is supported within container 17 so that it can oscillate about shaft 28.

Furthermore, as shown in FIG. 6, base 16 can be secured to the inner surface of container 17 with a spring 29 in a position at an appropriate distance from shaft 28. Because main body 11 is supported by shaft 28 and spring 29, main body 11 is constantly supported inside container 17 and substantially parallel to container 17. Thus, during tooth brushing, the elasticity of spring 29 imparts oscillating motion to main body 11 without an excess inclination. In this embodiment, one end of spring 29 is attached to the end portion of the rear surface of base 16, which is opposite to the surface where the first protruding portions 14 are provided. The other end of spring 29 is attached to the inner surface of container 17 facing the above-mentioned attachment region. Spring 29 can be connected to container 17 and main body 11 in various positions as long as the attachment does not hinder second protruding portion 15 from sliding with respect to first protruding portions 14.

Container 17 can also optionally include an auxiliary brush 30 that can be placed against the surface of the teeth during tooth brushing, thereby stabilizing the entire toothbrush with respect to the surface of the teeth. As a result, brush portion 13 can oscillate in a direction perpendicular to the surface of the teeth, with the auxiliary brush 30 serving as a point of support. Furthermore, based on the amount that auxiliary brush 30 is compressed during brushing, it is possible to adjust the brushing force or to check whether brush portion 13 is placed against the surface of the teeth at an appropriate angle. In this embodiment, auxiliary brush 30 is formed at the end portion of the outer surface of container 17 close to brush portion 13 and brush bristles of auxiliary brush 30 extend in the same direction as in the brush bristles of brush portion 13. If the length of the bristles in auxiliary brush 30 is about 1 mm shorter than the longest portions of bristles in brush portion 13, the bristles can make tight contact with the surface of the teeth. Therefore, a useful effect can be obtained by providing optional auxiliary brush 30.

Sliding member 12 is formed in the shape of a cylinder and is adapted to move along the periphery of container 17. Sliding member 12 may be formed so that it can slide over first protruding portions 14. For example, it may be in the form of a plate-like body sliding along the side of container 17 on which first protruding portions 14 are provided. If container 17 has a linear shape, sliding member 12 may have an arch-like or ring-like shape.

A second protruding portion 15 is provided on the inner surface of sliding member 12, which faces first protruding portions 14 of main body 11. In this embodiment, the second protruding portion 15 is formed as a peak penetrating into opening 19 of container 17. As shown in FIGS. 6, 9, the second protruding portion 15 is formed as a single wave-like peak with a top-bottom height difference greater than that of the peaks and valleys of first protruding portions 4. Furthermore, sliding member 12 is formed to have a length approximately equal to that of the second protruding portion 15 so that the second protruding portion 15 can slide along all first protruding portions 14.

When teeth are brushed with the toothbrush of this embodiment, container 17 is held with one hand and placed so that the brush bristles of brush portion 13 and auxiliary brush 30 form an angle of about 45° to 90° with respect to the surface of the teeth. Then, sliding member 12 is moved relative to main body 11. Since this toothbrush is provided with container 17, the oscillating motion generated between first protruding portions 14 and second protruding portion 15 is not absorbed by the hand holding the toothbrush. Furthermore, because a lever principle is used, the generated oscillating motion is appropriately amplified and effectively transmitted to the brush portion 13.

Furthermore, since brush portion 13 is divided and a plurality of movable brushes 22 are installed, each movable brush 22 can slide along brush shaft 20 and move into the position in which it can easily penetrate into the interproximal areas or periodontal pockets, thereby providing for effective tooth brushing. Furthermore, the adjacent interproximal areas can be reliably brushed at the same time.

Moreover, since base 16 of main body 11 is connected to container 17 by spring 29, the main body 11 elastically moves in the vertical direction, which makes it possible to attenuate any excess force. As a result, wear of surface of the teeth or interproximal areas is prevented and teeth can be effectively brushed.

In the above-described embodiment, a fixing means prohibiting the motion of each movable brush 22 may be also provided. A lock ring fit onto brush shaft 20 can be used as the fixing means. Alternatively, brush shaft 20 can be removably fit into base 16. When each movable brush 22 is fixed, the surface of the teeth can be effectively brush using known methods.

Third Representative Embodiment

Figure 10:
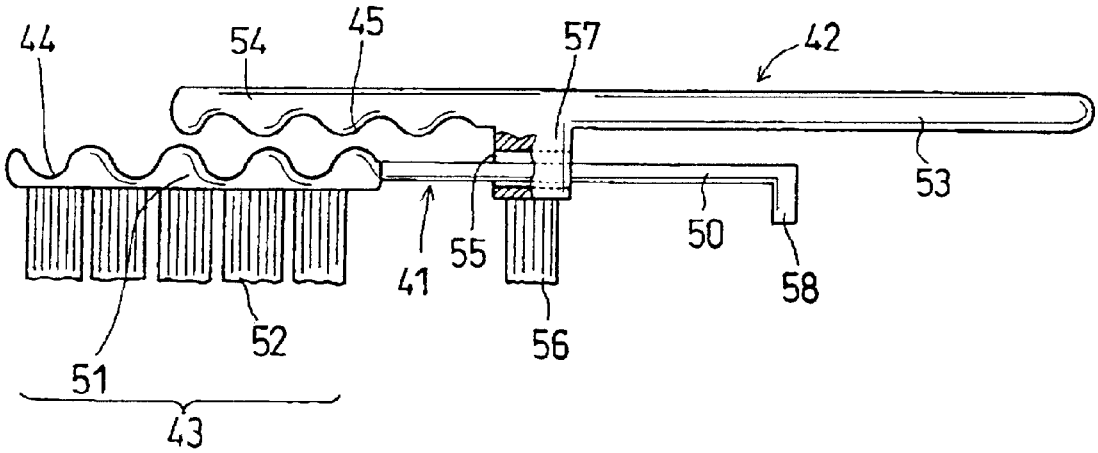
FIG. 10 is a side view of a third representative toothbrush.
Figure 11A:
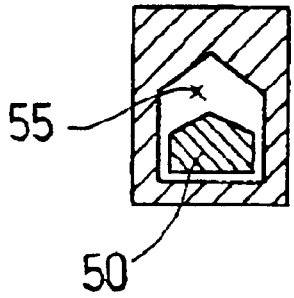
FIGS. 11(*a*), (*b*), (*c*) are lateral sectional views in which a connection shaft is inserted into the connection portion; this view illustrates a specific example of a representative cross sectional shape of the connection opening and the connection shaft.
Figure 11B:
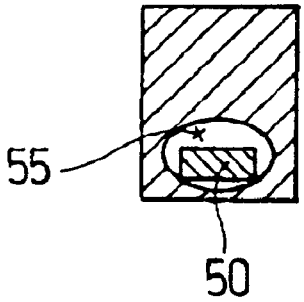
Figure 11C:
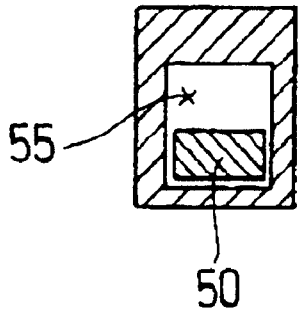
Figure 12:
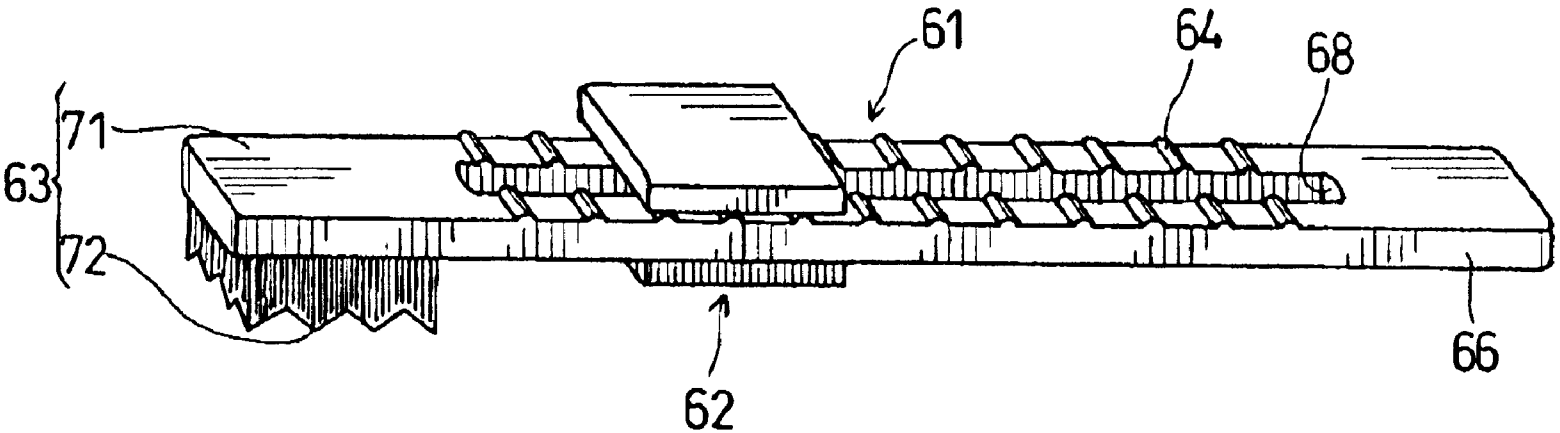
FIG. 12 is a perspective view of a fourths representative toothbrush.

A third representative toothbrush is shown in FIGS. 10 and 11, which toothbrush has a main body 41 and a sliding member 42. Main body 41 is formed to have an elongated shape with a brush portion 43 at a terminal end. Sliding member 42 is formed to have an elongated shape and is installed so that it can be moved relative to main body 41 in the direction almost parallel to the axial direction thereof.

Main body 41 has a brush portion 43 and a connection shaft 50. Brush portion 43 is includes a plate-like bristle base 51 and bristles 52 attached to one surface of bristle base 51. Connection shaft 50 is connected so as to have its axis parallel to the longitudinal direction of bristle base 51. Connection shaft 50 has a length greater than the length of brush portion 43 in the longitudinal direction.

In this embodiment, a lock 58 extending in the same direction as the bristles in brush portion 43 is formed at the end of connection shaft 50, which is on the end of connecting shaft 50 opposite to brush portion 43. Lock 58 prevents the separation of sliding member 42 and main body 41.

Main body 41 has first protruding portions 44 on the rear surface, in relation to bristles 52 of bristle base 51 of brush portion 43. As shown in FIG. 10 first protruding portions 44 comprise a plurality of peaks having an almost semispherical cross section and a length equal to the width of base 51 on the above-mentioned rear surface along the longitudinal direction of brush portion 13. As a result, first protruding portions 44 form a wave of gently sloping peaks and valleys only in the direction along the long axis of brush portion 43 over the rear surface of brush base 51.

In the toothbrush of this embodiment, when first protruding portions 44 are provided over the whole bristle base 51 in the longitudinal direction thereof, the oscillating motion obtained in a single slide of sliding member 42 over main body 41 is increased, which is a useful effect. Furthermore, in particular, if first protruding portions 44 are provided with a shape such that peaks and valleys are present only in the direction along the longitudinal axis of brush portion 43 and there are no peaks and valleys in the lateral direction, then tottering and shaking can be suppressed, which is a useful effect.

Sliding member 42 has an elongated base 53, which is formed so as to be longer than main body 41. An extended portion 54 having a plate-like shape and a length approximately equal to that of brush portion 43 in the longitudinal direction thereof is provided on one side of base 53.

Second protruding portions 45 may be formed on one surface of extended portion 54. Preferably, second protruding portions 45 are provided on the surface of extended portion 54 facing first protruding portions 44. Second protruding portions 45 a formed as a plurality of wave-like valleys with a top-bottom difference less than that of first protruding portions 44 over the whole surface of extended portion 54.

Second protruding portions 45 are provided at least on the front end portion of extended portion 54. If they are provided over the whole surface of extended portion 54, stable oscillating motion can be obtained, which is a useful effect. Furthermore, in this embodiment, first protruding portions and second protruding portions are provided close to brush portion 43. In order to insert the toothbrush into the oral cavity, it is preferred that the second protruding portions 45 should be provided as valleys to decrease the thickness of the section containing protruding portions 44, 45.

In sliding member 42, the base 53 adjacent to extended portion 54 has a connection portion 57 protruding from the surface provided with second protruding portions 45 almost perpendicular to this surface. A through connection orifice 55, which is parallel to the long axis of sliding member 42, is formed in connection portion 57. A connection shaft 50 of main body 41 is passed through and connected with connection orifice 55. Connection shaft 50 is passed through connection orifice 55 so that first protruding portions 44 of bristle base 51 face second protruding portions 45 of extended portion 54.

Connection orifice 55 and connection shaft 50 are formed to have a shape that does not hinder the oscillating motion of brush 43 of main body 11 induced by the oscillating motion generated by sliding second protruding portions 45 with respect to first protruding portions 44. Connection orifice 55 of sliding member 42 is formed to have a cross sectional shape larger than that of connection shaft 50, at least in the bristle direction of brush portion 43 (e.g., the protrusion direction of connection portion 57).

Furthermore, if the cross section of connection shaft 50 has a polygonal shape, rotation of connection shaft 50 within connection orifice 55 is minimized, which is a useful effect. Moreover, if the connection shaft 50 has a cross sectional shape that is elongated in the direction perpendicular to the bristle direction, tottering of brush portion 43 in the lateral direction can be suppressed, which is a useful effect.

Examples of such shapes are shown in FIGS. 11 (*a*)–(*c*). In this embodiment, as shown in FIG. 11 (*c*), connection shaft 50 is formed to have a rectangular cross sectional shape with rounded corners, which is elongated in the lateral direction. Connection orifice 55 is formed to have a rectangular shape, which is larger than connection shaft 50 in the bristle direction.

In this embodiment, an auxiliary brush 56 may be installed on top of connection portion 57 of sliding member 42. Auxiliary brush 56 is formed by attaching the brush bristles in the direction parallel to the bristle direction in brush portion 43. If the auxiliary brush 56 is installed so that bristle ends thereof are shorter by about 2 mm than the bristle ends in brush portion 43, the surface of the teeth does not wear during tooth brushing and the interproximal areas can be brushed effectively, which is a useful effect. Similarly to auxiliary brush 30 of the second representative embodiment, the auxiliary brush 56 serves as an indicator of appropriate angle or appropriate pressure during tooth brushing.

When teeth are brushed using the toothbrush of this embodiment, the sliding member 42 is held with a hand close to one end thereof and the toothbrush is placed so that brush bristles of brush portion 43 and auxiliary brush 56 form an angle of about 45–90° with respect to the surface of the teeth. Then, the sliding member 42 is moved parallel to the surface of the teeth relative to the position of main body 41. Because the oscillating motion generated by first protruding portions 44 and second protruding portions 45 is transmitted to brush portion 43, absorption of the oscillating motion by the hand is suppressed and the surface of the teeth can be effectively brushed by oscillations in the direction perpendicular thereto.

Furthermore, auxiliary brush 56 can move parallel to the surface of the teeth, and the surface of the teeth can be brushed using known methods.

Fourth Representative Embodiment

A fourth representative toothbrush is shown in FIGS. 2 to 14, which fourth representative embodiment is a modification of the first representative embodiment. The toothbrush of the fourth representative embodiment may include main body 61 formed to have an almost rod-like shape and a sliding member 62 installed so that it can slide with respect to main body 61.

Main body 56 has an elongated base 66 and a brush portion 63. Brush portion 63 is provided with a plate-like bristle base 71 formed at one end of base 56 and bristles 72 on one surface of bristle base 71.

In brush portion 63 of this embodiment, brush locks 74 extending from bristle base 71 are provided inside bristles 72. Brush locks 74 are components which are placed against the teeth during tooth brushing to prevent the main body 61 from moving together with sliding member 62. Brush locks 74 are preferably elastic and adapted to closely adhere to the surface of the teeth. In order not to hinder brushing of interproximal areas and periodontal pockets with bristles 72, brush locks 74 are preferably shorter than the brush bristles, for example, by about 3–4 mm. Furthermore, if the periodontal pockets are deep, it is preferred that brush locks 74 are even shorter. An appropriate number of brush locks 74 can be installed in the prescribed positions in side bristles 72. If they are installed in positions having a left-right symmetry with respect to the axial line of bristle base 71, the brush can be effectively maintained in the fixed position, whether the brushing direction is to the left or to the right, which is a useful effect.

Figure 13:
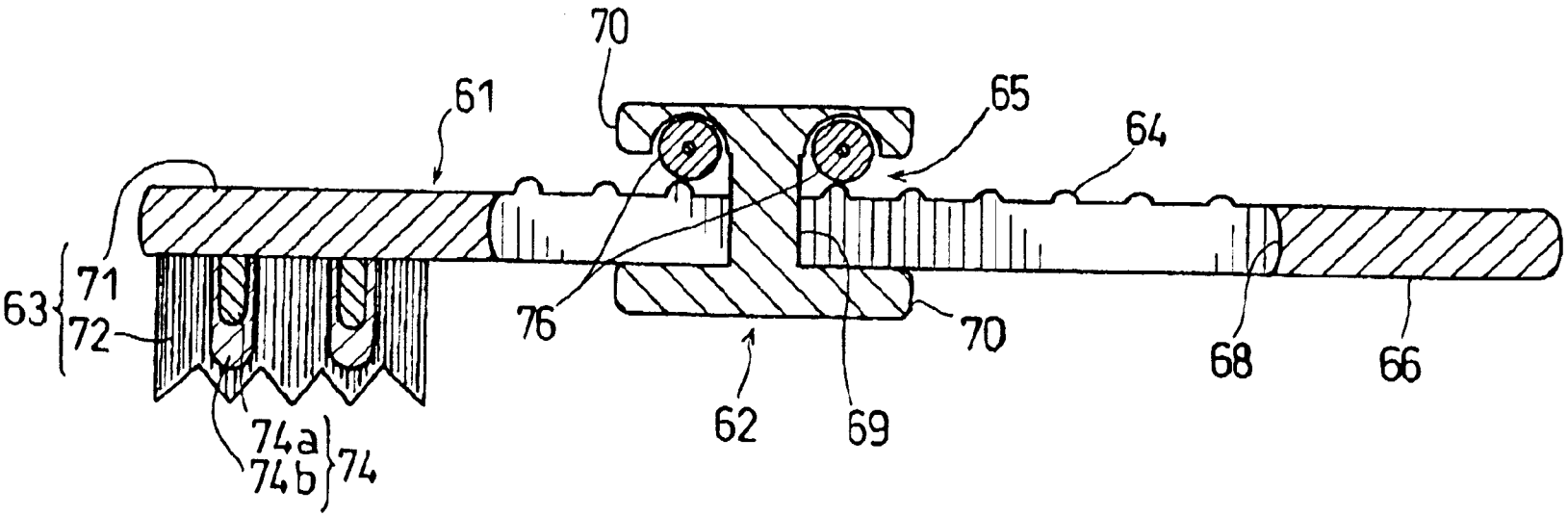
FIG. 13 is a side sectional view of the toothbrush shown in FIG. 12

In this embodiment, brush lock 74, as shown in FIG. 13, is formed from a shaft 74*a* and a flexible cap 74*b*. Shaft 74*a* is a rod-like body having high rigidity and extending from bristle base 71 perpendicular thereto. Flexible cap 74*b* has a rubber rod-like portion and covers the shaft 74*a*. Brush lock 74 is preferably shorter than the bristle tips of bristles 72. In this embodiment, brush locks 74 are installed singly along the center of lines dividing the bristles 72, thereby dividing bristles 72 into three equal sections along the axial direction.

The height of brush locks 74 in this embodiment can be freely changed according to the depth of periodontal pockets and the like by replacing caps 74*b* with different length caps 74*b*.

Main body 61 has first protruding portions 64, which are provided on the surface of base 66 perpendicular to the bristle direction and on the rear side of main body 61 with respect to bristles 72. First protruding portions 64 are formed on a flat section by providing a plurality of rod-like projections, which extend in the lateral direction of base 66, along the longitudinal direction. First protruding portions 64 are formed so as to have a top-bottom height difference that is less than the top-bottom height difference of the first protruding portions 4.

In the present embodiment, connection groove 68 is formed in the portion of base 66 where the first protruding portions 64 are provided. Connection groove 68 passes in the bristle direction of brush portion 63 along the axial line of base 66. Sliding member 62 is connected via the connection groove 68.

Figure 14:
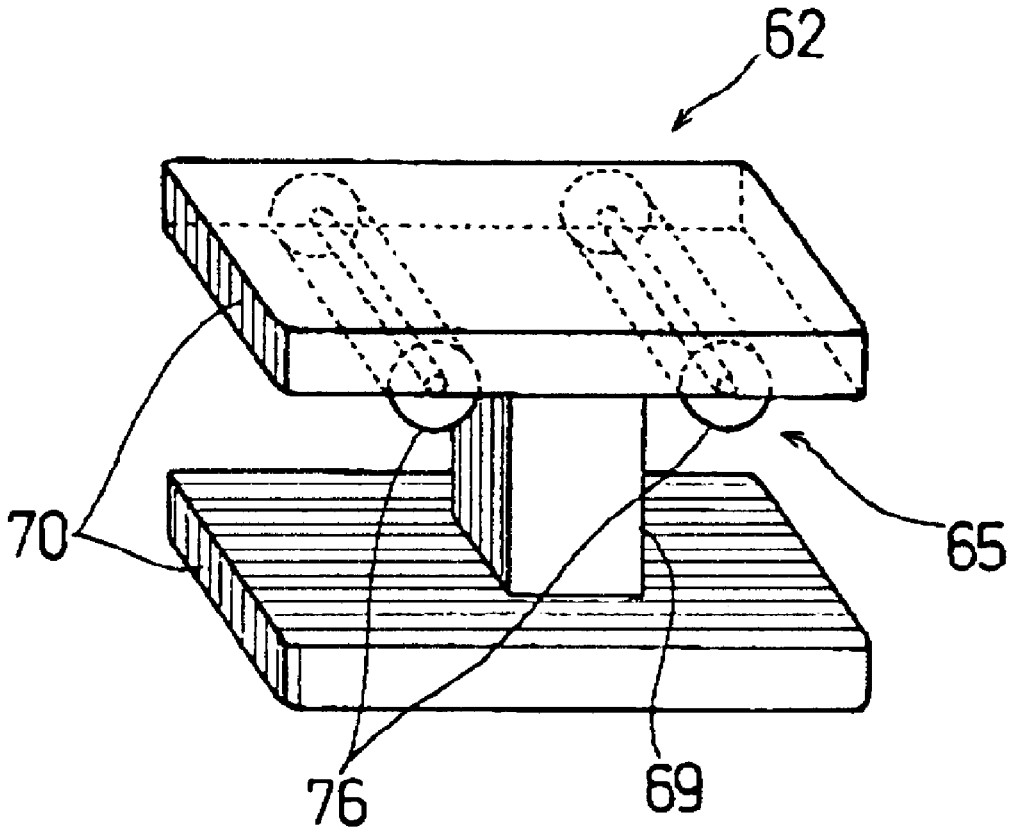
FIG. 14 is a perspective view of the sliding member shown in FIG. 12.

Sliding member 62, as shown in FIGS. 13 and 14, may include two plate-like members 70 and a holding shaft 69. The two plate-like members 70 are connected by holding shaft 69 approximately in the center thereof so that they extend almost parallel to each other. Holding shaft 69 is passed through a connection groove 68 of main body 61, and the two plate-like members 70 face the surface of base 66 of main body 61 where the first protruding portions 64 are provided, and the rear surface thereof, respectively. Holding shaft 69 maintains the sliding member 62 in a state in which it is connected to main body 61. Holding shaft 69 is formed so as to have a rectangular cross section and to glide freely inside the connection groove 68, without rotation inside the connection groove 68.

Sliding member 62 has second protruding portions 65 in the form of peaks and valleys on the surface facing first protruding portions 64. In this embodiment, second protruding portions 65 are formed on the surface of plate-like member 70 facing first protruding portions 64. Second protruding portions 65 have rotary bodies 76 comprising rotary shafts set along the lateral direction of base 66 as the peaks. Rotary bodies 76 are arranged on both sides of connection shaft 69 parallel to plate-like member 70. The upper part of rotary bodies 76 is contained in the recesses formed in plate-like member 70, and the lower part thereof protrudes in a semicircular fashion from the flat surface of plate-like member 70. The top-bottom difference of peaks and valleys of second protruding portions 65 is greater than the top-bottom difference of peaks and valleys of first protruding portion 64. Furthermore, rotary bodies 76 are formed to have an outer diameter such that they can run generally along the wave-like shape of first protruding portions 64 when they are caused to slide over first protruding portions 64.

With the toothbrush of this embodiment, the sliding member 62 can be held with one hand so that it can be moved relative to the main body, while at the same time supporting the main body. Therefore, tooth brushing can be performed using one land by holding only the sliding member 62 and not holding the main body 61. Furthermore, the surface of the teeth can be also brushed by known methods by holding only the main body 61, without using the sliding member 62.

Moreover, the toothbrush of this embodiment is provided with brush locks 74 inside brush portion 63. Therefore, stable tooth brushing can be performed. Furthermore, because the size of the wave-like shape of first protruding portions 64 is decreased and rotary bodies 76 are installed in second protruding portions 65, the friction force acting between first protruding portions 64 and second protruding portions 65 is decreased. Therefore, the sliding member 62 can move smoothly and effectively and tooth brushing can be conducted with a small force. Because of these two effects, the toothbrush of this embodiment make it possible to brush the teeth using one hand. Furthermore, because connection shaft 69 is installed in sliding member 62, and connection groove 68 is provided in main body 61, tottering of sliding member 62 in the lateral direction is reduced and it can easily slide in the longitudinal direction.

Furthermore, if the surface of rotary bodies 76 is formed from rubber or the like to provide for an appropriate friction resistance, then rotation of rotary bodies 76 during sliding can be facilitated and second protruding portions 65 can be caused to slide with a small force.

Fifth Representative Embodiment

Figure 15:
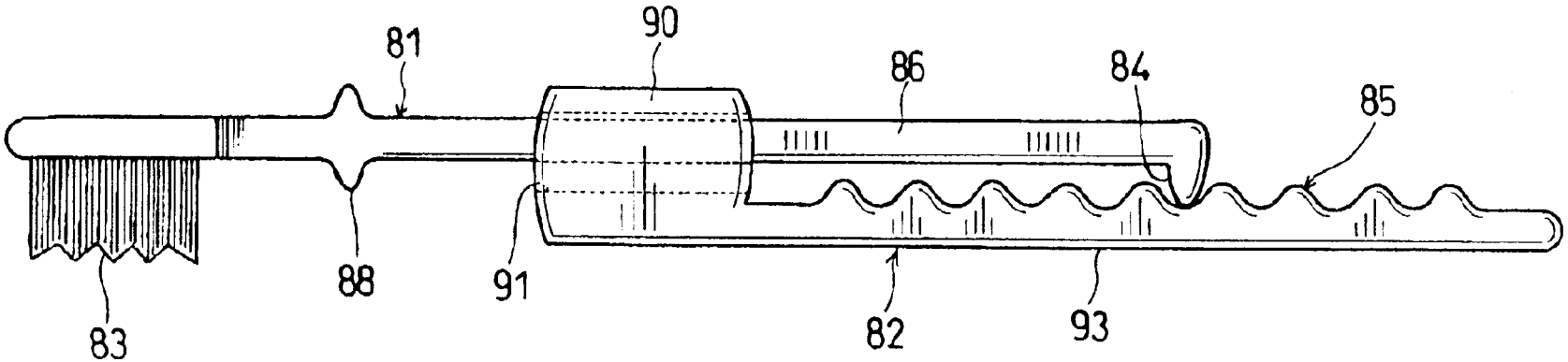
FIG. 15 is a side view of a fifth representative toothbrush.

FIG. 15 shows a fifth representative toothbrush that includes main body 81 having a brush portion 83 at one end and a sliding member 82 having an elongated shape.

Main body 81 has an elongated base 86 and a brush portion 83. Base 86 is formed to have a cross section in the shape of an almost an equal sided triangle. Brush portion 83 has a bristle base formed to have a flat plate-like shape and a brush portion formed by tightly attaching brush bristles onto one surface of the bristle base. The tufted surface of the bristle base (of the brush portion) is provided so as to form a plane almost matching one surface of base 86.

Base 86 can be formed to have various cross sectional shapes. In this embodiment, it is preferred that the base be formed so as to decrease the peripheral surface area of brush portion 83 on the rear side of the bristles. Thus, if the contact surface area with the below-described sliding member 82 is decreased in order to decrease the friction resistance, then sliding member 82 can be effectively forced to move over main body 81 with a smaller force. If for this purpose the base 86 is provided with a cross sectional shape which has a decreased surface area on the rear side of the bristle surface, for example, in the form of a trapezoid or regular pentagon, in addition to the regular triangle shape of this embodiment, then a useful effect is obtained.

First protruding portion 84 is provided on the same side of the bristle surface and the end of base 86, which is opposite to brush portion 83. In this embodiment, first protruding portion 84 is formed as a single curved projection to obtain a larger number of oscillating motions with a single motion of sliding member 82.

In the embodiment shown in FIG. 15, a disk-like lock 88 extending in the radial direction of the axial line of base 86 is provided in the section on the brush portion 83 side of base 86. Lock 88 can block the sliding of the sliding member 82 to the brush portion 83 and prevent the lips from being caught between main body 81 and sliding member 82 and the gums from being damaged.

Sliding member 82 may include a cylindrical portion 90 and a rod-like extended portion 93 elongated from one end of cylindrical portion 90 in the direction of opening of cylindrical portion 90. The base 86 is passed through the opening 91 of cylindrical portion 90 in such a manner that the first protruding portion 84 is located on the side of extended portion 93; as a result, the sliding member 82 is installed so that it can slide over main body 81.

Cylindrical portion 90 is a cylindrical body and has an opening 91 with an almost rectangular cross section in its center. The opening 91 is formed is that its lateral width is almost equal to the length of one side of the cross section of base 86 and so that it is larger in the bristle direction than the thickness of base 86.

Extended portion 93 is an elongated section that extends almost in parallel to the axial line of opening 91 from one end of cylindrical portion 90. Sliding member 82 is formed so that a total length including that of cylindrical portion 90 and extended portion 93 is almost equal to the length of base 86 of main body 81.

Extended portion 93 has second protruding portions 85, which are formed on the side of extended portion 93 facing the main body 81. Second protruding portions 85 are preferably formed to have a continuous wave-like shape. It is preferred that second protruding portions 85 have as long a length as possible. Therefore, second protruding portions 85 are provided along the entire length of extended portion 93. Second protruding portions 85 can be caused to run along the first protruding portions 84 and have a shape preventing engagement with first protruding portions 84.

A step can be formed between the second protruding portions 85 and the opening edge of opening 91. By forming the step so that it can mate with first protruding portion 84, it is possible to prevent sliding member 82 from coming off the main body 81.

Furthermore, a roller can be installed on the inner surface opening 91 of cylindrical portion 90 so as to be in the opening edge on the side where no extended portion 93 is formed and to be on the side opposite to extended portion 93. Thus, if the roller is installed in the section which is in contact with main body 81 when the sliding member 82 is caused to slide, the load applied to main body 81 by the motion of sliding member 82 can be decreased and the sliding member 82 can be caused to move with a smaller force.

Furthermore, a projection protruding higher than second protruding portion 85 may be provided at the end of extended portion 93 of sliding member 82 instead of lock 88 that was provided on main body 81 in this embodiment. In this case, first protruding portion 84 can be prevented from protruding beyond the extended portion 93, and the cylindrical portion 90 can be prevented from reaching the brush portion 83.

In order to brush the teeth with the toothbrush of this embodiment, the sliding member 82 is held with one hand and placed so that the brush bristles of brush portion 83 of main body 81 form an angle of about 45–90° with the surface of the teeth. Then, sliding member 82 is caused to move in the axial direction of main body 81 and oscillating motion is generated. This oscillating motion is transmitted to brush portion 83, and the interproximal areas and periodontal pockets can be brushed by the motion in the direction perpendicular to the surface of the teeth.

In the toothbrush of this embodiment, a long sliding member 82 was installed and the friction resistance between main body 81 and sliding member 82 was decreased, which made it possible to brush using only one hand.

Furthermore, oscillating motion generated by the common action of first protruding portion 84 and second protruding portion 85 is effectively transmitted to brush portion 83 in accordance with the lever principle for which the section of base 86 of main body 81 serves as a point of support. Main body 81 is in contact with the edge of opening 91 of cylindrical portion 90 of sliding member 82.

Sixth Representative Embodiment

Electrical means may be coupled to the sliding member in order to cause the sliding member to reciprocally move with respect to the main body. This embodiment therefore may make brushing more convenient, because the user is not required to physically slide the sliding member with respect to the main body. As in the above-described embodiments, reciprocal movement generated by the electric means will cause the first and second protruding portions to slide with respect to each other and cause the brush portion to oscillate in a direction perpendicular to the surface of the teeth. Preferably, a motor or other electric means may be coupled to the sliding member in order to reciprocally move the siding member with respect to the main body. The type of electric means for reciprocally moving the sliding member is not particularly limited, and various electrical devices may be utilized with the present teachings. For example, the sliding member could be reciprocally moved by a linear motor. A battery may be provided to supply power to the electrical or an electric cord may be provided to connect the toothbrush to an electrical outlet.

Furthermore, with the toothbrushes of all of the above-described embodiments, the surface of the teeth, for example, the occlusion surface, can be also brushed using known methods by holding the main body or the container with one hand, that is, without using any the sliding members. In particular, if the sliding member is formed so that it can be separated from the main body, tooth brushing can be conducted by holding only the main body and the toothbrush can be used easily.

In addition, although various features of the present teachings have been taught as various different embodiments, the various features can be combined to form other embodiments that are not specifically taught, but which other embodiments are clearly within the scope of the present teachings.

What is claimed is:

1. A toothbrush comprising:

a main body comprising a brush portion having brush bristles and a shaft and means for oscillating the brush bristles in a direction perpendicular to a longitudinal axis of the main body comprising a sliding member adapted to slide along the shaft of the main body and cause the brush portion to oscillate in the direction perpendicular to the longitudinal axis of the main body.

2. A toothbrush as in claim 1, wherein the oscillating means comprises:

at least one first protruding portion formed on the shaft of the main body, and at least one second protruding portion formed on the sliding member and disposed opposite of the at least one first protruding portion, wherein the at least one second protruding portion slidably contacts the at least one first protruding portion.

3. A toothbrush as in claim 2, wherein the at least one first protruding portion and the brush bristles are disposed on the same side of the main body.

4. A toothbrush as in claim 2, wherein the at least one first protruding portion and the brush bristles are provided on opposite sides of the main body.

5. A toothbrush as in claim 1, wherein the sliding member is removably coupled to the shaft.

6. A toothbrush as in claim 1, wherein the sliding member comprises a connection portion having a cylindrical portion extending in the axial direction of the main body.

7. A toothbrush as in claim 1, wherein the sliding member is adapted to slide along a rail disposed on the shaft.

8. A toothbrush as in claim 1, wherein the sliding member comprises rollers adapted to slide along the shaft.

9. A toothbrush as in claim 1, wherein the brush portion comprises a fixed brush and at least one movable brush that is adapted to move in the longitudinal direction of the main body.

10. A toothbrush as in claim 1, wherein the brush portion further comprises at least one protrusion extending in parallel with the brush bristle, which protrusion is adapted to fix the position of brush portion with respect to teeth during brushing.

11. A toothbrush as in claim 1, further comprising a fixed auxiliary brush coupled to the main body.

12. A toothbrush as in claim 1, further comprising a container that surrounds at least the first protruding portion of the main body, wherein the sliding member is also adapted to slide with respect to the container.

13. A toothbrush as in claim 12, wherein any position between the first protruding portion and the brush portion serves as a point of support.

14. A toothbrush as in claim 13, further comprising a spring attached to an inner surface of the container, wherein one end of the support point of the main body inside of the container is biased by the spring.

15. A toothbrush as in claim 1, wherein the oscillating means further comprises a support member adapted to support the main body and permit the main body to oscillate with respect to the support member, wherein a portion of the main body closest to the brush portion serves as a point of support.

16. A toothbrush as in claim 1, wherein the oscillating means further comprises electrical means coupled to the sliding member for reciprocally moving the sliding member with respect to the main body.

17. A toothbrush as in claim 1, wherein one of the main body and the sliding member has at least one hole or depression and the other of the main body and the sliding member has at least one protrusion and wherein the at least one hole or depression and the at least one protrusion are adapted to cause the brush portion to oscillate in the direction perpendicular to the longitudinal axis of the main body when the sliding member slides along the shaft of the main body.

18. A method of using the tooth brush of claim 1 to brush teeth comprising:

holding the main body in a substantial fixed position with respect to the teeth and simultaneously sliding the sliding member along the shaft of the main body in order to cause the brush portion to oscillate in the direction perpendicular to the teeth.

19. A toothbrush comprising:

a main body comprising a brush portion having brush bristles and a shaft having at least one first protrusion, the main body defining a longitudinal axis and a sliding member having at least one second protrusion, the sliding member being arranged and constructed to slide along the longitudinal axis of the main body and cause the brush portion to oscillate in a direction perpendicular to the longitudinal axis of the main body.

20. A toothbrush as in claim 19, wherein the at least one first protrusion and the brush bristles are disposed on the same side of the main body, wherein the brush portion further comprises at least one protrusion extending in parallel with the brush bristle and adapted to fix the position of brush portion with respect to teeth during brushing, wherein the main body further comprises a fixed auxiliary brush.

21. A toothbrush comprising:

a main body comprising a brush portion having brush bristles and a shaft coupled to the brush portion, wherein at least one first protrusion extends substantially perpendicularly from a longitudinal axis of the shaft, and a sliding member slidably coupled to the shaft so as to slide along the longitudinal axis of the shaft, the sliding member comprising at least one second protrusion, the at least one second protrusion being arranged and constructed to slidably contact the at least one first protrusion when the sliding member is slid relative to the main body, thereby causing the brush portion to oscillate in a direction substantially perpendicular to the longitudinal axis of the main body.

22. A toothbrush as in claim 21, further comprising a plurality of second protrusions disposed on the sliding member and arranged and constructed to slidably contact the at least one first protrusion.

23. A toothbrush as in claim 22, wherein the sliding member comprises a substantially cylindrical portion coupled to an extended portion, wherein the shaft is slidably inserted within the substantially cylindrical portion and the second protrusions project from the extended portion.

24. A toothbrush as in claim 23, further comprising a lock extending substantially perpendicularly from the longitudinal axis of the shaft, the lock being disposed between the brush bristles and the substantially cylindrical portion.

25. A toothbrush as in claim 24, wherein the at least one first protrusion and the second protrusions are defined as wave-shaped projections.

26. A toothbrush as in claim 25, wherein the second protrusions extend along substantially one entire side of the extended portion.

27. A method for brushing teeth comprising:

holding the main body of the toothbrush of claim 26 in a substantial fixed position with respect to the teeth, and simultaneously sliding the sliding member along the shaft of the main body in order to cause the brush portion to oscillate perpendicularly to the surface of the teeth.

28. A method for brushing teeth comprising:

holding the main body of the toothbrush of claim 21 in a substantial fixed position with respect to the teeth, and simultaneously sliding the sliding member along the shaft of the main body in order to cause the brush portion to oscillate perpendicularly to the surface of the teeth.

* * * * *